US010392762B2

(12) United States Patent
Kueper

(10) Patent No.: US 10,392,762 B2
(45) Date of Patent: Aug. 27, 2019

(54) SNOW-CLEARING STRIP FOR THE SNOW-CLEARING BLADE OF A SNOWPLOW

(71) Applicant: Kueper GmbH & Co. KG, Bochum (DE)

(72) Inventor: Roland Kueper, Bochum (DE)

(73) Assignee: Kueper GmbH & Co. KG, Bochum (DE)

( * ) Notice: Subject to any disclaimer, the term of this patent is extended or adjusted under 35 U.S.C. 154(b) by 0 days.

(21) Appl. No.: 15/762,163

(22) PCT Filed: Oct. 16, 2017

(86) PCT No.: PCT/EP2017/076301
§ 371 (c)(1),
(2) Date: Mar. 29, 2018

(87) PCT Pub. No.: WO2018/073155
PCT Pub. Date: Apr. 26, 2018

(65) Prior Publication Data

US 2019/0078279 A1 Mar. 14, 2019

(30) Foreign Application Priority Data

Oct. 18, 2016 (DE) ..... 10 2016 119 769

(51) Int. Cl.
*E01H 5/06* (2006.01)

(52) U.S. Cl.
CPC ..... *E01H 5/066* (2013.01); *E01H 5/061* (2013.01); *E01H 5/065* (2013.01)

(58) Field of Classification Search
CPC ..... E01H 5/061; E01H 5/062; E01H 5/065; E01H 5/066
USPC ..... 37/233, 266, 270, 407
See application file for complete search history.

(56) References Cited

U.S. PATENT DOCUMENTS 3,934,654 A * 1/1976 Stephenson ..... E01H 5/061 172/701.3
4,288,932 A * 9/1981 Kuper ..... E01H 5/061 37/233
4,347,677 A * 9/1982 Kuper ..... E01H 5/061 37/233
5,136,795 A * 8/1992 Rosenberg ..... E01H 5/06 37/231

(Continued)

FOREIGN PATENT DOCUMENTS

DE 36 40 565 A1 6/1988
DE 10 2004 029 165 A1 12/2005
KR 101 158 262 B1 6/2012

OTHER PUBLICATIONS

International Search Report of PCT/EP2017/076301, dated Jan. 29, 2018.

*Primary Examiner* — Gary S Hartmann
(74) *Attorney, Agent, or Firm* — Collard & Roe, P.C.

(57) ABSTRACT

A snow-clearing strip for the snow-clearing blade of a snowplow has an attachment neck, onto which an elongated rubber body is vulcanized, which body has a wear section that projects downward and is freely flexible, and in which hard-material wear bodies are embedded over the wear height. A reinforcement is attached to the attachment neck, which reinforcement extends over at least the upper third of the wear height and is connected with the rubber body with material bonding.

16 Claims, 6 Drawing Sheets

(56) References Cited

U.S. PATENT DOCUMENTS

| | | | | |
|---|---|---|---|---|
| 5,471,770 | A * | 12/1995 | Ferreira | E01H 5/061 172/719 |
| 6,571,493 | B2 * | 6/2003 | Amano | B22F 7/06 172/701.3 |
| 7,765,726 | B2 | 8/2010 | Kueper | |
| 8,640,365 | B2 * | 2/2014 | Kueper | E01H 5/061 37/233 |
| 2018/0202119 | A1 * | 7/2018 | Talou | E01H 5/061 |
| 2018/0313048 | A1 * | 11/2018 | Lynch | E01H 5/061 |

* cited by examiner

SNOW-CLEARING STRIP FOR THE SNOW-CLEARING BLADE OF A SNOWPLOW

CROSS REFERENCE TO RELATED APPLICATIONS

This application is the National Stage of PCT/EP2017/076301 filed on Oct. 16, 2017, which claims priority under 35 U.S.C. § 119 of German Application No. 10 2016 119 769.6 filed on Oct. 18, 2016, the disclosure of which is incorporated by reference. The international application under PCT article 21(2) was not published in English.

The invention relates to a snow-clearing strip for the snow-clearing blade of a snowplow, having an attachment neck, onto which an elongated rubber body is vulcanized, which body has a wear section that projects downward, is freely flexible, and into which hard-material wear bodies are embedded above the wear height. Such a snow-clearing strip is known, for example, from DE 10 2004 029 165 A1.

Originally, snow-clearing strips for the snow-clearing blade of a snowplow were produced from steel. Such snow-clearing strips can clear snow thoroughly and quickly. A great disadvantage of such steel strips, however, lies in that they wear out very quickly and furthermore can damage the surface to be cleared, above all lane markings or the like. In particular, they are not suitable in areas of use in which relatively uneven surfaces to be cleared occur, such as, for example, cobblestone paving, or in which flying sparks must absolutely be prevented such as, for example, airport fields.

For this reason, a transition has occurred in the case of snow-clearing strips for such areas of use, to producing the snow-clearing strips from a rubber body, which is vulcanized onto an attachment neck. The snow-clearing strip is attached to the snow-clearing blade by way of this attachment neck. The rubber body adapts to the surface to be cleared and does not damage it. The risk of flying sparks does not exist when using a snow-clearing strip having a rubber body. For this reason, it is well suited for the areas of use mentioned above. A disadvantage of such a snow-clearing strip, however, is that the wear surface of the rubber body that comes into contact with the surface to be cleared is relatively blunt and therefore demonstrates disadvantageous sliding behavior. Specifically in the case of relatively high snow-clearing speeds, jumping and stuttering of the snow-clearing strip occurs. Due to this jumping, not only is the attachment of the snow-clearing strip on the snow-clearing blade subject to great stress, but also the entire snow-clearing blade is caused to make small leaps. Furthermore, the snow-clearing result is also worsened due to jumping of the snow-clearing strip.

For this reason, hard-material wear bodies are vulcanized into the rubber body in the case of snow-clearing strips of the type stated initially. This measure is generally known nowadays. In this regard, it is practical if the hard-material wear bodies are composed of a material having good sliding properties, for example of corundum. The wear bodies are distributed over the entire wear section of the rubber body as uniformly as possible; this section is defined by the wear surface and the wear height. As a result, the wear surface has the same ratio of rubber surface and hard-material surface at almost all times, so that the sliding behavior of the snow-clearing strips does not change during use, and the snow-clearing strip wears uniformly. Due to the improvement in sliding behavior, jumping of the snow-clearing strip is prevented. In this regard, however, the snow-clearing strip retains its ability to adapt to unevenness of the surface to be cleared, since the hard-material wear bodies can move back into the rubber body. In contrast to a snow-clearing strip having a rubber body without hard-material wear bodies, not only can the snow-clearing speeds be increased with such a snow-clearing strip, but also the snow-clearing result can be improved. This is particularly important for use on airport fields, because here, the highest demands with regard to the snow-clearing result and the snow-clearing speed must be met by the snow-clearing strips.

Due to the increasing snow-clearing speed, however, a new, previously unknown wear problem for snow-clearing strips of the type stated initially has arisen. At a greater snow-clearing speed, the impact forces that occur frontally, parallel to the surface to be cleared, due to unevenness of the surface to be cleared, are also reinforced. These impact forces put stress on the snow-clearing strip with a bending moment. Due to this bending moment, the rubber body is at risk of tearing, in particular on the front side, in the region above the wear height, so that a rupture location occurs, and the connection with the attachment neck comes loose, little by little. The region in the rubber body, in which the lower end of the attachment neck is situated, forms a further weak point, since the attachment neck is normally configured with a sharp edge. Due to material fatigue in these regions, replacement of the snow-clearing strip can become necessary before the actual wear region has been used up. The average useful lifetimes of the snow-clearing strips are thereby reduced, specifically at relatively high speeds and/or relatively uneven surfaces to be cleared. Furthermore, it can be very difficult to recognize material fatigue, in part, because it takes place inside the snow-clearing strip. The snow-clearing strip can therefore surprisingly become unusable during a snow-clearing procedure.

It is therefore the task of the invention to improve the wear resistance of a snow-clearing strip of the type stated initially, to the effect that it is suitable for use at high snow-clearing speeds and/or on uneven surfaces to be cleared, and, at the same time, achieves longer useful lifetimes.

To accomplish this task, the invention proposes, proceeding from a snow-clearing strip of the type stated initially, that a reinforcement is attached to the attachment neck, which reinforcement extends over at least the upper third of the wear height and is connected with the rubber body with material bonding.

Due to the reinforcement in the region above the wear height the snow-clearing strip is reinforced here and is less flexible, so that the impact deformation in the case of frontal impacts in the lower region of the snow-clearing strip is distributed more uniformly over the entire height of the snow-clearing strip. At the same time, the bending moment caused by the impacts is also better distributed.

It is practical if the reinforcement is vulcanized into the rubber body adjacent to the front side of the snow-clearing strip. As a result, the region at the front side is protected against being torn open, so that no rupture point forms in this region.

Alternatively to this, the reinforcement is vulcanized onto the front side of the snow-clearing strip. By means of this measure, as well, the region above the wear height is protected against being torn open.

A practical embodiment provides that the reinforcement has at least one ply of reinforcement threads. As a result, the tear resistance of the rubber body, in particular, can be increased, since the reinforcement threads can partially absorb the forces that bend the rubber body.

It is practical if at least some of the reinforcement threads are disposed parallel to the wear height. Reinforcement threads oriented parallel to the wear height can absorb the bending forces that bend the rubber body downward to the rear, particularly well.

Furthermore, it is practical if at least some of the reinforcement threads are disposed perpendicular to the wear height. Specifically in the outer edge regions, the snow-clearing strip is subject to stress by additional bending forces, which bend the rubber body not only toward the rear but also outward. Due to the reinforcement threads that are oriented perpendicular to the wear height, the snow-clearing strip is also better protected against wear caused by these bending forces.

A further preferred embodiment provides that the reinforcement has the form of a woven fabric. A woven fabric is particularly well suited for absorbing tensile forces that occur during bending of the snow-clearing strip. Bending itself also does not damage the woven fabric.

In the case of a reinforcement in the form of a woven fabric, it is furthermore practical if the warp thread density of the woven fabric increases along the wear height, from the bottom to the top. Since the snow-clearing strip is subject to greater stress caused by bending in the upper region, the woven fabric reinforcement can be adjusted to the stress, which increases from the bottom to the top, by way of the warp thread density.

As a further alternative, the reinforcement consists of multiple reinforcement rods oriented parallel to the wear height and distributed uniformly over the length of the snow-clearing strip. By means of this measure, as well, the snow-clearing strip is reinforced in the upper region, so that the bending moment is absorbed by the reinforcement rods, at least in part.

In this embodiment of the reinforcement, it is practical if the diameter of the reinforcement rods increases along the wear height, from the bottom to the top, in order to distribute the bending moment over the height of the snow-clearing strip as uniformly as possible.

A further alternative embodiment provides that the reinforcement has at least one metal sheet. A metal sheet is also suitable for reinforcing the snow-clearing strip in the upper region and for absorbing the bending moment, so that the snow-clearing strip is prevented from tearing open in the upper region.

Similar to a reinforcement by means of reinforcement rods, it is practical, in this embodiment, if the thickness of the metal sheet increases along the wear height, from the bottom to the top.

It is practical if a further reinforcement is attached at the outer side surfaces. Specifically at the outer side surfaces, the snow-clearing strip is frequently subject to stress, particularly caused by obstacles, for example by the curbstone. By means of the reinforcement in this region, the snow-clearing strip is also better protected against the impacts caused by obstacles there.

Furthermore, it is practical if the further reinforcement at the outer side surfaces consists of reinforcement threads oriented parallel to the surface to be cleared. The snow-clearing strip is subject to great stress, at its outer side surfaces, caused by frequent or even constant contact with the curbstone, due to forces that act parallel to the surface to be cleared. The snow-clearing strip is particularly well protects at its outer side surfaces by means of the orientation of the reinforcement threads in the direction of these forces.

In the selection of the reinforcement material, it is important that this material has good tensile strength but is also flexible. For this reason, it is particularly practical if the reinforcement consists, at least in part, of aramid, spring steel, Fiberglas or a similar material.

In order to protect the region in the interior of the snow-clearing strip against wear, it is practical if the attachment neck is beveled or rounded off at its lower edge. As a result the attachment neck no longer has a sharp edge and therefore no longer cuts into the rubber body in this region.

In the following, the invention will be described in greater detail using drawings.

Figure 1:
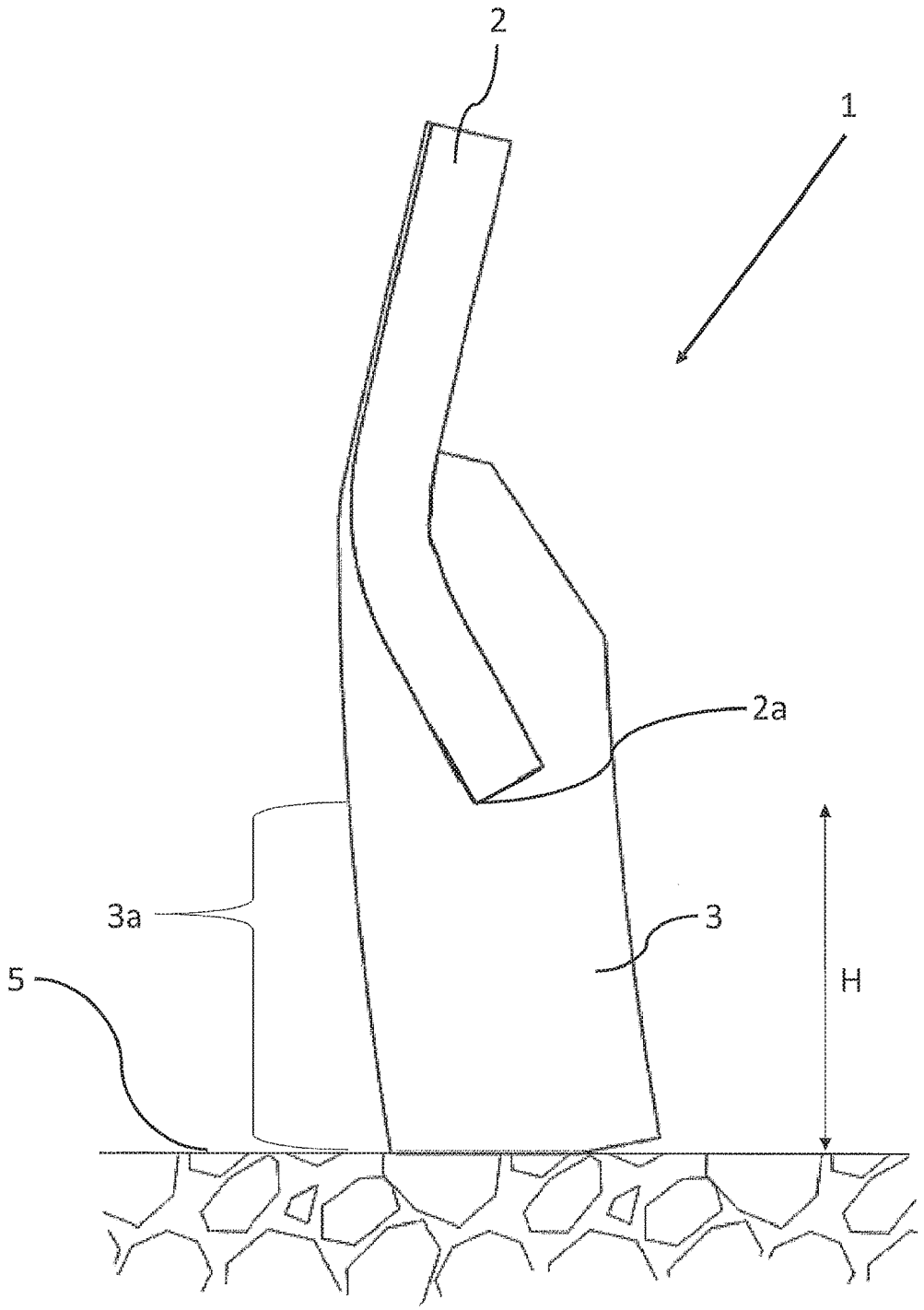
Prior Art FIG. 1
FIG. 1 shows: schematically, a side view of a snow-clearing strip according to the state of the art in the case of stress.

In the drawing, the snow-clearing strip in its totality is identified with the reference symbol 1, in each instance. Each snow-clearing strip has an attachment neck 2, onto which an elongated rubber body 3 is vulcanized. The snow-clearing strip 1 is attached to a snow-clearing blade of a snowplow, not shown, by way of the attachment neck 2. The elongated rubber body 3 has a wear section 3*a*. Hard-material wear bodies 4 are vulcanized into the rubber body 3 over the wear height H.

In FIG. 1, a snow-clearing strip 1 according to the state of the art is shown in the stressed state, in other words during use. Due to the contact with the surface 5 to be cleared, a bending force acts on the snow-clearing strip 1. This bending force increases as a function of the speed of the snowplow and the sliding properties. Furthermore, frontal impacts can come about due to unevenness of the surface 5 to be cleared, which impacts further reinforce the bending force.

Figure 2:
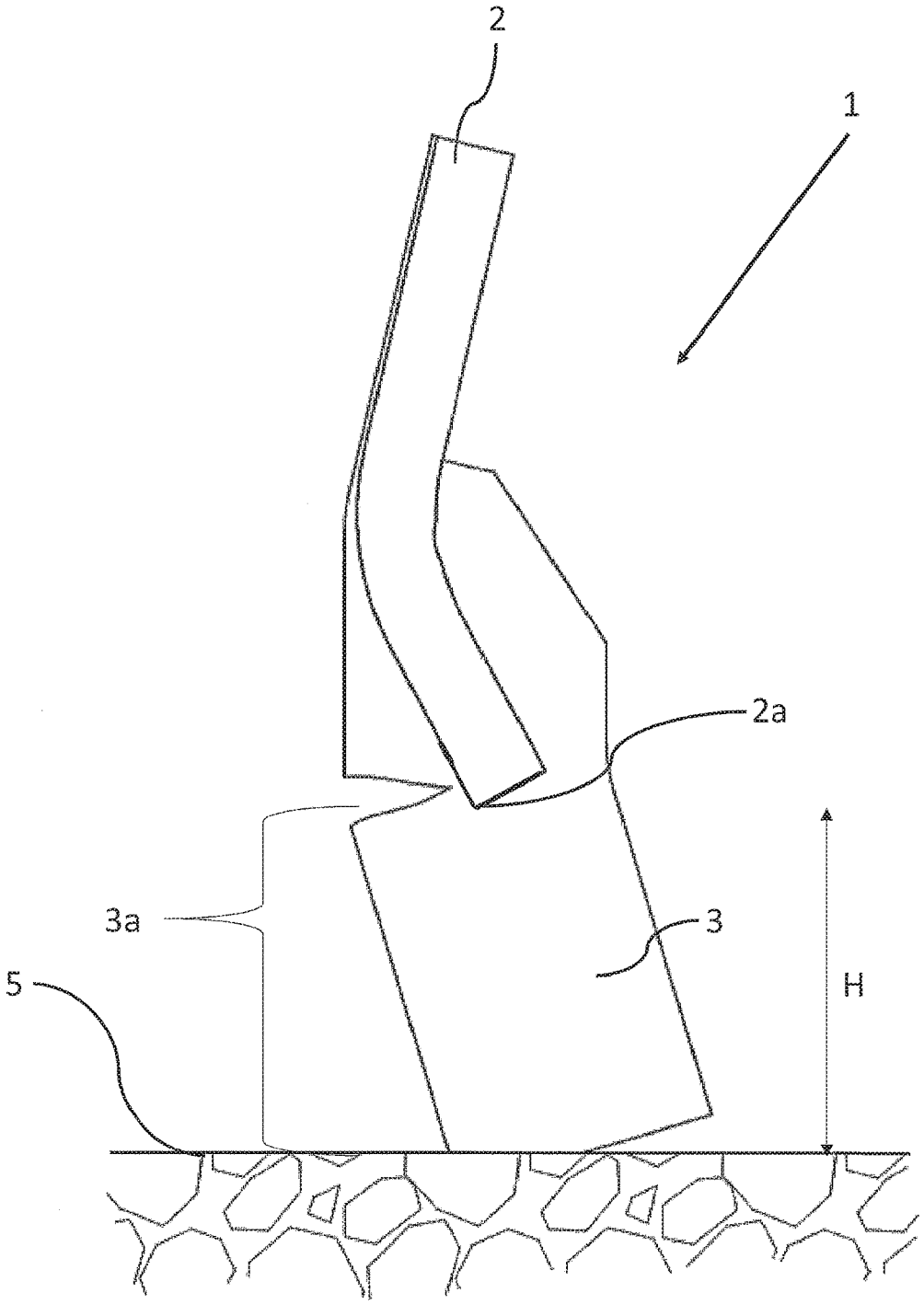
Prior Art FIG. 2
FIG. 2 shows: schematically a side view of a snow-clearing strip according to the state of the art in the case of stress, with a planned breaking point.

Due to the bending force, the rubber body 3 is at risk of tearing. The risk of such tearing is particularly high at the upper end of the wear section. As soon as a first, small tear has formed, it represents a weak point so that the tear propagates more and more during further use. After some time, the snow-clearing strip 1 is no longer suitable for use, and part of the rubber body 3 is actually at risk of breaking off, as shown in FIG. 2.

A further weak point is represented by the relatively sharp-edged corner 2*a* at the end of the attachment neck 2. Here, too a tear can quickly form, which tear increases in size during further use and thereby significantly accelerates wear of the snow-clearing strip 1. Furthermore, such a propagating tear in the interior of the snow-clearing strip 1 could not be identified, or could only be identified with great effort.

According to the invention, the snow-clearing strip 1 is therefore provided with a reinforcement 6, which is attached to the attachment neck 2 and is connected with the rubber body 3 with material bonding.

Figure 3:
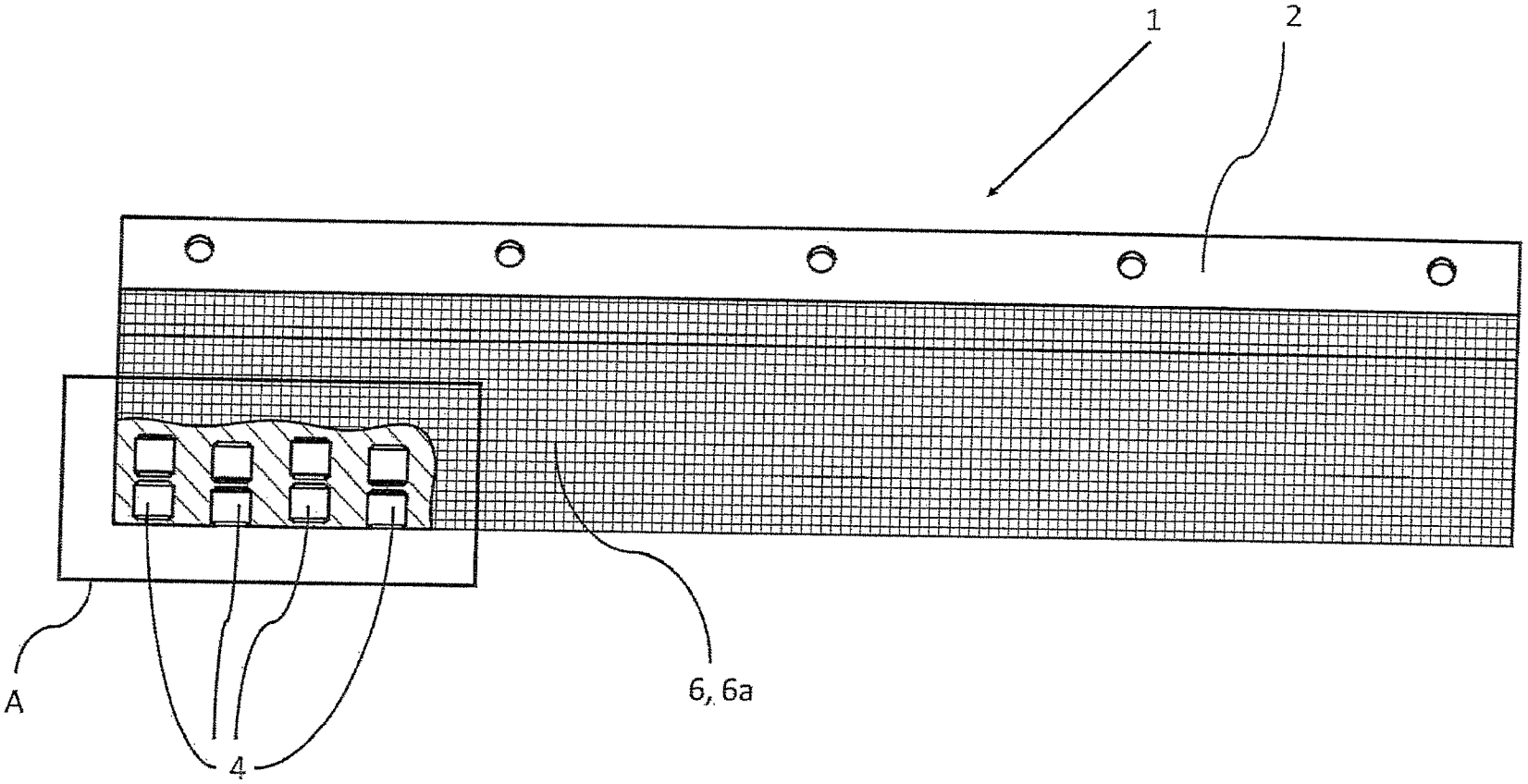
FIG. 3 shows: schematically, a front view of a snow-clearing strip according to the invention in a first exemplary embodiment.

A first exemplary embodiment is shown in FIG. 3. The reinforcement 6 consists, in this case, of a woven reinforcement fabric 6*a* composed of aramid, which is vulcanized onto the front side of the rubber body 3 and onto the attachment neck 2. The woven reinforcement fabric 6*a* extends over the entire front side of the rubber body 3 and over part of the attachment neck 2. In the region of the detail A, the hard-material wear bodies 4 vulcanized into the rubber body 3 are shown.

Figure 4:
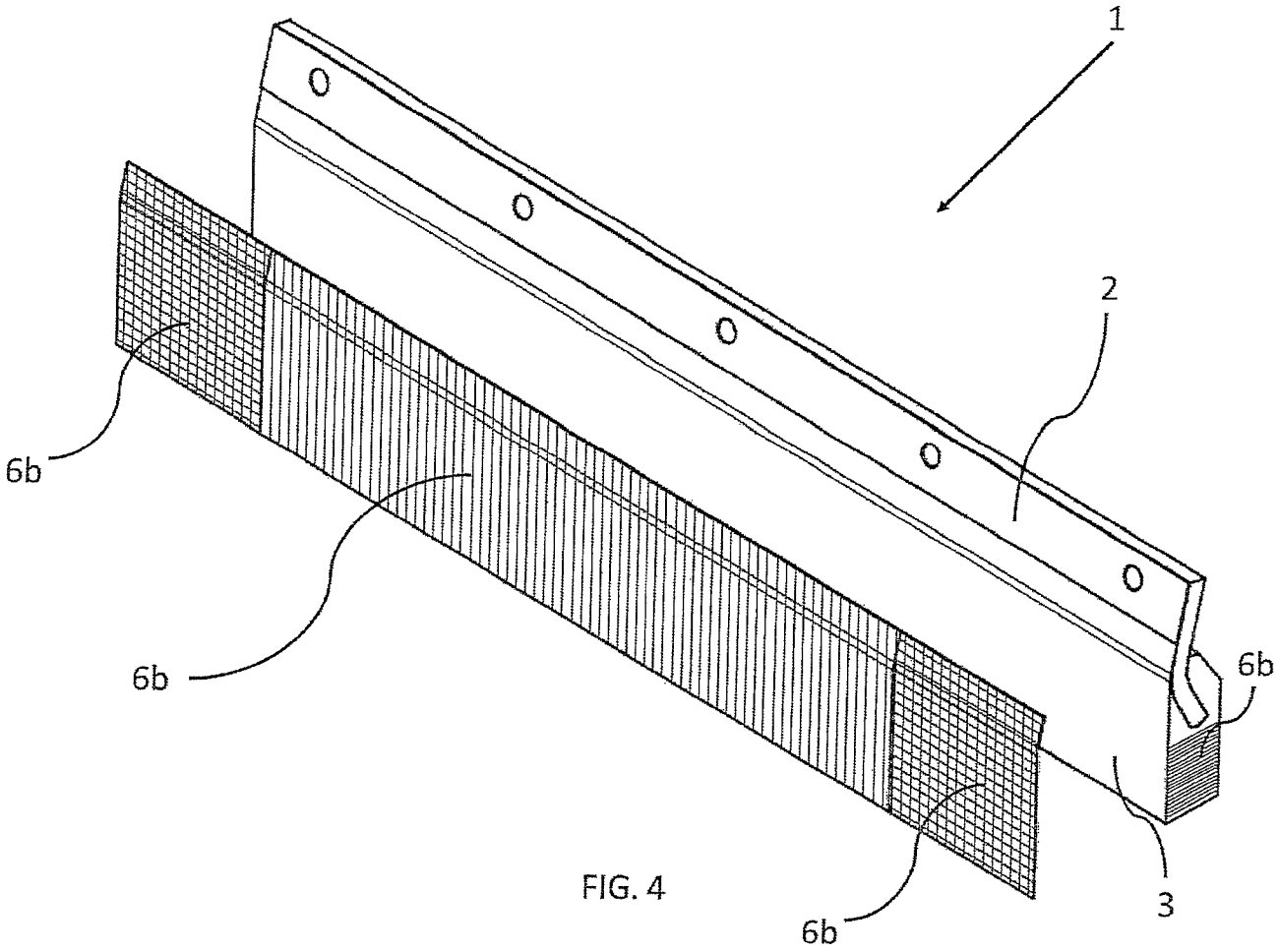
FIG. 4 shows: schematically, a 3D view of a snow-clearing strip according to the invention even before affixation of the reinforcement, in a second exemplary embodiment.
Figure 5:
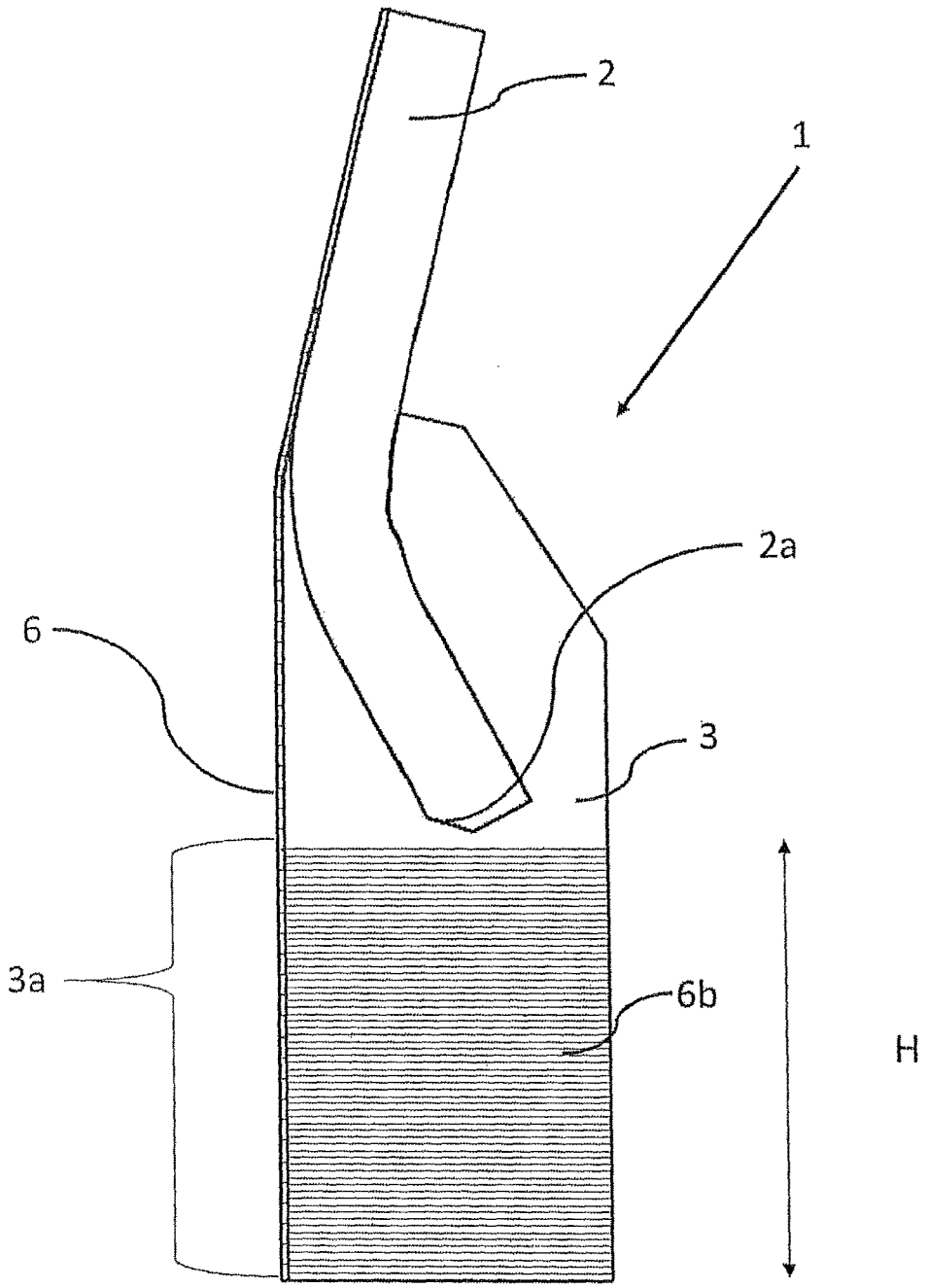
FIG. 5 shows: schematically, a side view of a snow-clearing strip according to the invention.
Figure 6:
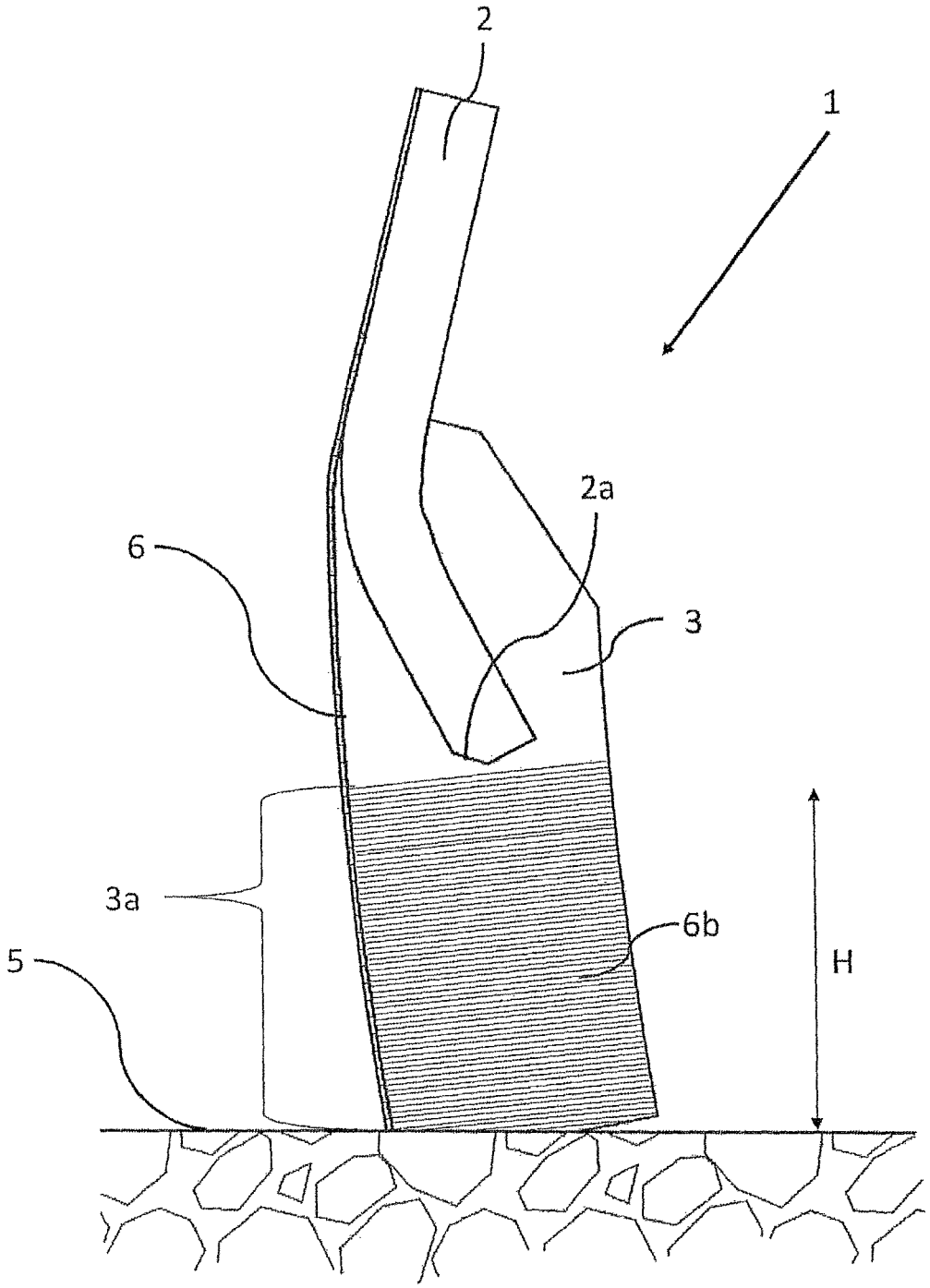
FIG. 6 shows: schematically, a side view of the snow-clearing strip according to FIG. 5 in the case of stress.

A second exemplary embodiment is shown in FIGS. 4 and 5. Reinforcement threads 6*b* are provided perpendicular and parallel to the wear height H, at the outer edge regions, in each instance, as a reinforcement 6. In the center region of the snow-clearing strip 1, only reinforcement threads 6*b* parallel to the wear height H are provided. Experience has shown that the outer regions of the snow-clearing strip 1 are generally subject to greater stress, since unevenness occurs more frequently in the edge region of the surface 5 to be cleared, for example lane markings or the like, which lead to additional bending stresses. As a result, the snow-clearing strip 1 is subject not only to bending stress toward the rear but also to bending stress outward in these regions. Because of the reinforcement threads 6*b* perpendicular to the wear height H, the snow-clearing strip is also better protected against these bending forces. Furthermore, reinforcement threads 6*b* oriented parallel to the surface to be cleared are also provided at the outer side surface of the snow-clearing strip, in order to protect the snow-clearing strip against additional stress, for example caused by contact with the curbstone, in this region. If the snow-clearing strip 1 according to the invention is now subject to bending stress during use, as described above, the front side of the rubber body 3 is protected against tearing by the reinforcement 6. This is because the reinforcement 6 absorbs a major portion of the bending force, as shown in FIG. 6. Other embodiments and materials can also be provided for the reinforcement 6. For example, it can be structured in the form of reinforcement rods or a metal reinforcement sheet. The materials should be as tear-resistant as possible. A reinforcement composed of spring steel or fiberglass would also be possible.

As is furthermore shown in FIG. 3-6, the lower corner 2*a* of the attachment neck 2 is beveled, so that here, no tear forms in the interior of the snow-clearing strip 1.

In total, the snow-clearing strip 1 in these embodiments achieves greater robustness during use and therefore longer useful lifetimes.

REFERENCE SYMBOL LIST

1 snow-clearing strip
2 attachment neck
2*a* lower corner 2*a* of the attachment neck
3 rubber body
3*a* wear section
H wear height
4 hard-material wear body
5 surface to be cleared
6 reinforcement
6*a* woven reinforcement fabric
6*b* reinforcement threads

The invention claimed is:

1. A snow-clearing strip for the snow-clearing blade of a snowplow, having
an attachment neck and
an elongated rubber body vulcanized onto the attachment neck,
wherein the elongated rubber body has a wear section that projects downward and is freely flexible,
wherein hard-material wear bodies are embedded in the elongated rubber body above the wear height,
wherein a reinforcement is attached to the attachment neck and extends over at least the upper third of the wear height and is connected with the rubber body with material bonding, and
wherein the reinforcement has at least one ply of reinforcement threads.

2. The snow-clearing strip according to claim 1, wherein the reinforcement is vulcanized into the rubber body adjacent to the front side of the snow-clearing strip.

3. The snow-clearing strip according to claim 1, wherein the reinforcement is vulcanized onto the front side of the snow-clearing strip.

4. The snow-clearing strip according to claim 1, wherein at least some of the reinforcement threads are disposed parallel to the wear height.

5. The snow-clearing strip according to claim 1, wherein at least some of the reinforcement threads are disposed perpendicular to the wear height.

6. The snow-clearing strip according to claim 1, wherein the reinforcement has at least one metal reinforcement sheet.

7. The snow-clearing strip according to claim 6, wherein the thickness of the metal reinforcement sheet increases along the wear height, from bottom to top.

8. The snow-clearing strip according to claim 1, wherein a further reinforcement is attached at the outer side surfaces.

9. The snow-clearing strip according to claim 1, wherein the reinforcement comprises aramid, at least in part.

10. The snow-clearing strip according to claim 1, wherein the reinforcement comprises spring steel, at least in part.

11. The snow-clearing strip according to claim 1, wherein the reinforcement comprises fiberglass, at least in part.

12. The snow-clearing strip according to claim 1, wherein the attachment neck is beveled on a lower edge of the attachment neck.

13. The snow-clearing strip according to claim 1, wherein the attachment neck is rounded off on a lower edge of the attachment neck.

14. A snow-clearing strip for the snow-clearing blade of a snowplow, having
an attachment neck and
an elongated rubber body vulcanized onto the attachment neck,
wherein the elongated rubber body has a wear section that projects downward and is freely flexible,
wherein hard-material wear bodies are embedded in the elongated rubber body above the wear height,
wherein a reinforcement is attached to the attachment neck and extends over at least the upper third of the wear height and is connected with the rubber body with material bonding, and
wherein the reinforcement has the form of a woven reinforcement fabric, at least in part.

15. The snow-clearing strip according to claim 14, wherein the warp thread density of the woven reinforcement fabric increases along the wear height, from bottom to top.

16. A snow-clearing strip for the snow-clearing blade of a snowplow, having
an attachment neck and
an elongated rubber body vulcanized onto the attachment neck,
wherein the elongated rubber body has a wear section that projects downward and is freely flexible,
wherein hard-material wear bodies are embedded in the elongated rubber body above the wear height, wherein a reinforcement is attached to the attachment neck and extends over at least the upper third of the wear height and is connected with the rubber body with material bonding, wherein a further reinforcement is attached at the outer side surfaces, and wherein the further reinforcement at the outer side surfaces comprises reinforcement threads oriented parallel to the surface to be cleared.

* * * * *